US011284768B2

(12) United States Patent
Seo

(10) Patent No.: US 11,284,768 B2
(45) Date of Patent: Mar. 29, 2022

(54) VACUUM CLEANER

(71) Applicant: LG ELECTRONICS INC., Seoul (KR)

(72) Inventor: Jonghyun Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 853 days.

(21) Appl. No.: 15/080,885

(22) Filed: Mar. 25, 2016

(65) Prior Publication Data

US 2016/0296091 A1 Oct. 13, 2016

(30) Foreign Application Priority Data

Apr. 13, 2015 (KR) ..... 10-2015-0051699

(51) Int. Cl.

| | |
|---|---|
| ***A47L 11/40*** | (2006.01) |
| ***A47L 9/28*** | (2006.01) |
| ***A47L 9/00*** | (2006.01) |

(52) U.S. Cl.

CPC ..... *A47L 11/4005* (2013.01); *A47L 9/00* (2013.01); *A47L 9/28* (2013.01); *A47L 9/2889* (2013.01)

(58) Field of Classification Search

CPC . A47L 9/00; A47L 9/28; A47L 9/2889; A47L 11/4005; H05K 7/20154

USPC ..... 361/709; 310/64, 52

See application file for complete search history.

(56) References Cited

U.S. PATENT DOCUMENTS 3,257,784 A * 6/1966 Grellsson ..... A47L 9/22 55/472
5,023,973 A * 6/1991 Tsuchida ..... A47L 9/2821 15/319
5,134,749 A * 8/1992 Sakurai ..... A47L 5/362 15/325

(Continued)

FOREIGN PATENT DOCUMENTS

CA 2772890 A1 * 11/2012 ..... A47L 9/02
JP 01234030 A * 9/1989

(Continued)

OTHER PUBLICATIONS

"Power Semiconductor Devices—Thyristor and Triac." Electrical Engineering Portal. Oct. 15, 2011. <https://electrical-engineering-portal.com/power-semiconductor-devices-thyristor-and-triac>. (Year: 2011).*

(Continued)

*Primary Examiner* — Orlando E Aviles
*Assistant Examiner* — Thomas Raymond Rodgers
(74) *Attorney, Agent, or Firm* — KED & Associates LLP

(57) ABSTRACT

A vacuum cleaner is provided. The vacuum cleaner may include a cleaner body having a suction head that communicates with the cleaner body and a suction motor assembly to generate a suction force. The suction motor assembly may include a motor, a motor housing having a chamber to accommodate the motor, a housing cover configured to cover the motor housing and provided with an air inlet, a circuit board provided at an outside of the motor chamber and having at least one heat generating component installed thereupon, and a heat sink provided at the chamber and in contact with the at least one heat generating component. An installation part to install the circuit board may be provided at the motor housing.

12 Claims, 8 Drawing Sheets

(56) References Cited

U.S. PATENT DOCUMENTS 5,255,409 A * 10/1993 Fujiwara ..... A47L 9/0411 15/319
5,331,239 A * 7/1994 Kwun ..... H02K 17/30 310/68 R
5,763,969 A * 6/1998 Metheny ..... H02K 9/14 310/52
5,971,725 A * 10/1999 de Simon ..... F04D 19/04 417/423.1
6,229,232 B1 * 5/2001 Roth-Stielow ..... H02K 5/225 310/160
2002/0056169 A1 * 5/2002 Kushida ..... H02M 7/53873 15/319
2003/0172490 A1 * 9/2003 Onishi ..... A47L 9/327 15/327.2
2004/0231090 A1 * 11/2004 Kushida ..... A47L 5/22 15/326
2007/0079466 A1 * 4/2007 Cunningham ..... A47L 5/38 15/314
2007/0079469 A1 * 4/2007 Cunningham ..... A47L 5/38 15/319
2008/0295275 A1 * 12/2008 Yoo ..... A47L 9/2805 15/300.1
2009/0289513 A1 * 11/2009 Vadillo ..... H02K 9/14 310/62
2011/0222243 A1 * 9/2011 Nagami ..... B23K 9/1006 361/697
2013/0049550 A1 * 2/2013 Watanabe ..... F04C 29/063 310/67 R
2013/0162190 A1 * 6/2013 Smith ..... H02P 31/00 318/490
2014/0245562 A1 * 9/2014 Conrad ..... A47L 9/2884 15/323
2015/0009626 A1 * 1/2015 Lan ..... H05K 7/20154 361/696
2015/0076942 A1 * 3/2015 Madsen Obel ..... H02K 9/06 310/59
2015/0211548 A1 * 7/2015 Bang ..... F04D 29/5813 417/366
2015/0319839 A1 * 11/2015 Ichikawa ..... F04C 18/0215 310/64

FOREIGN PATENT DOCUMENTS

JP 2000217751 A * 8/2000
JP 2000342490 A * 12/2000
KR 10-2003-0033775 5/2003
KR 10-2005-0033937 A 4/2005
KR 2006093847 A * 8/2006
KR 10-0671891 B1 1/2007
KR 10-2011-0066784 A 6/2011

OTHER PUBLICATIONS

European Search Report dated Aug. 3, 2016 issued in Application No. 16162996.9.
Korean Office Action issued in Application No. 10-2015-0051699 dated Jan. 20, 2016.

* cited by examiner

VACUUM CLEANER

CROSS-REFERENCE TO RELATED APPLICATION

This application claims priority under 35 U.S.C. § 119 to Korean Application No. 10-2015-0051699, filed on Apr. 13, 2015, whose entire disclosure is incorporated herein by reference.

BACKGROUND

1. Field

A vacuum cleaner is disclosed herein.

2. Background

A vacuum cleaner is an apparatus that suctions air and objects such as, for example, dust, using a suction force generated by a suction motor installed inside a main body, and filters the dust from the air in the main body. Korean Patent Publication No. 2003-0033775, published on May 1, 2003, which is incorporated herein by reference, discloses a heat radiation structure of a circuit board for a vacuum cleaner.

The heat radiation structure of a circuit board for a vacuum cleaner of Korean Patent Publication No. 2003-0033775 includes a middle member, at which the circuit board may be installed, a motor housing, in which a plurality of exhaust air holes may be molded, an exhaust air duct extending from the exhaust air holes, and an air flow tube fastened to reach on one side of the circuit board from the exhaust air holes.

Since the circuit board is cooled by the air flowing in the air flow tube, a heat radiation performance of the circuit board may be degraded, and may require an additional structure to form an air flow tube. Due to a distance between the circuit board and the motor housing, a volume or size of the vacuum cleaner may increase.

BRIEF DESCRIPTION OF THE DRAWINGS

The embodiments will be described in detail with reference to the following drawings in which like reference numerals refer to like elements wherein.

DETAILED DESCRIPTION

Figure 1:
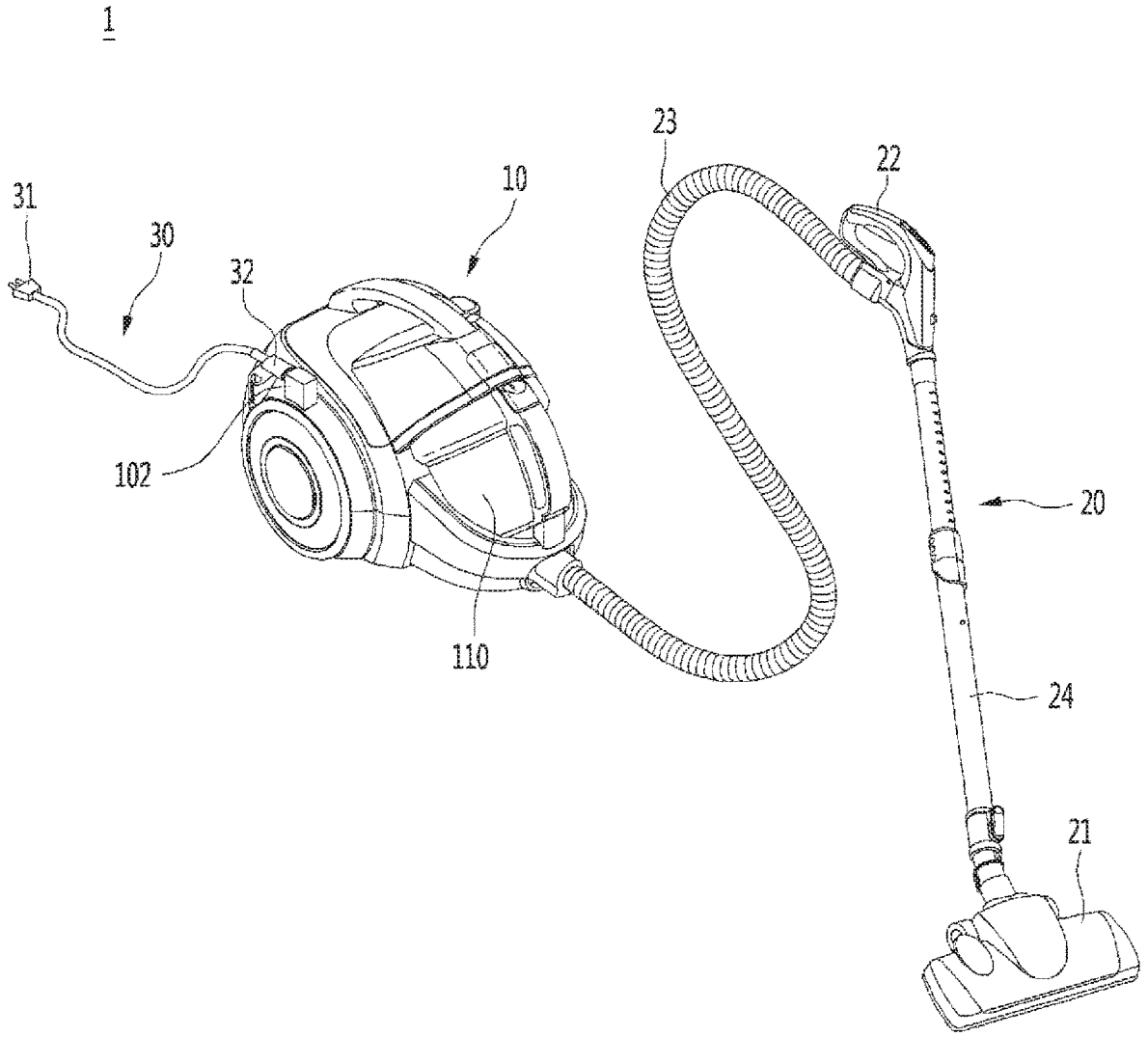
FIG. 1 is a perspective view of a vacuum cleaner according to an embodiment.
Figure 2:
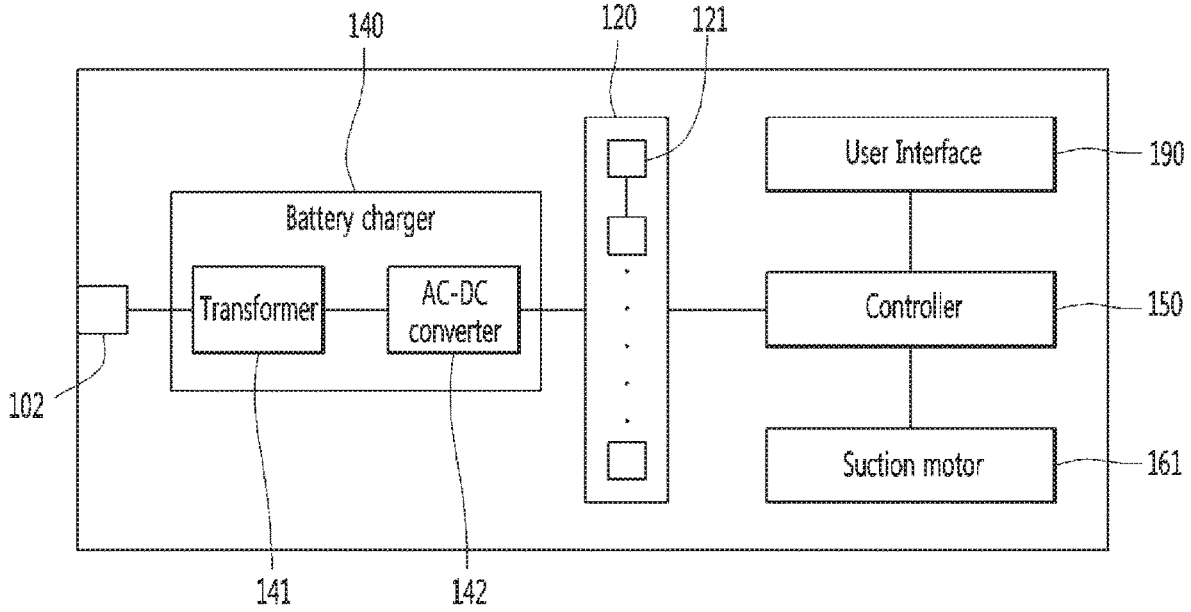
FIG. 2 is a schematic diagram of the vacuum cleaner according to an embodiment.
Figure 3:
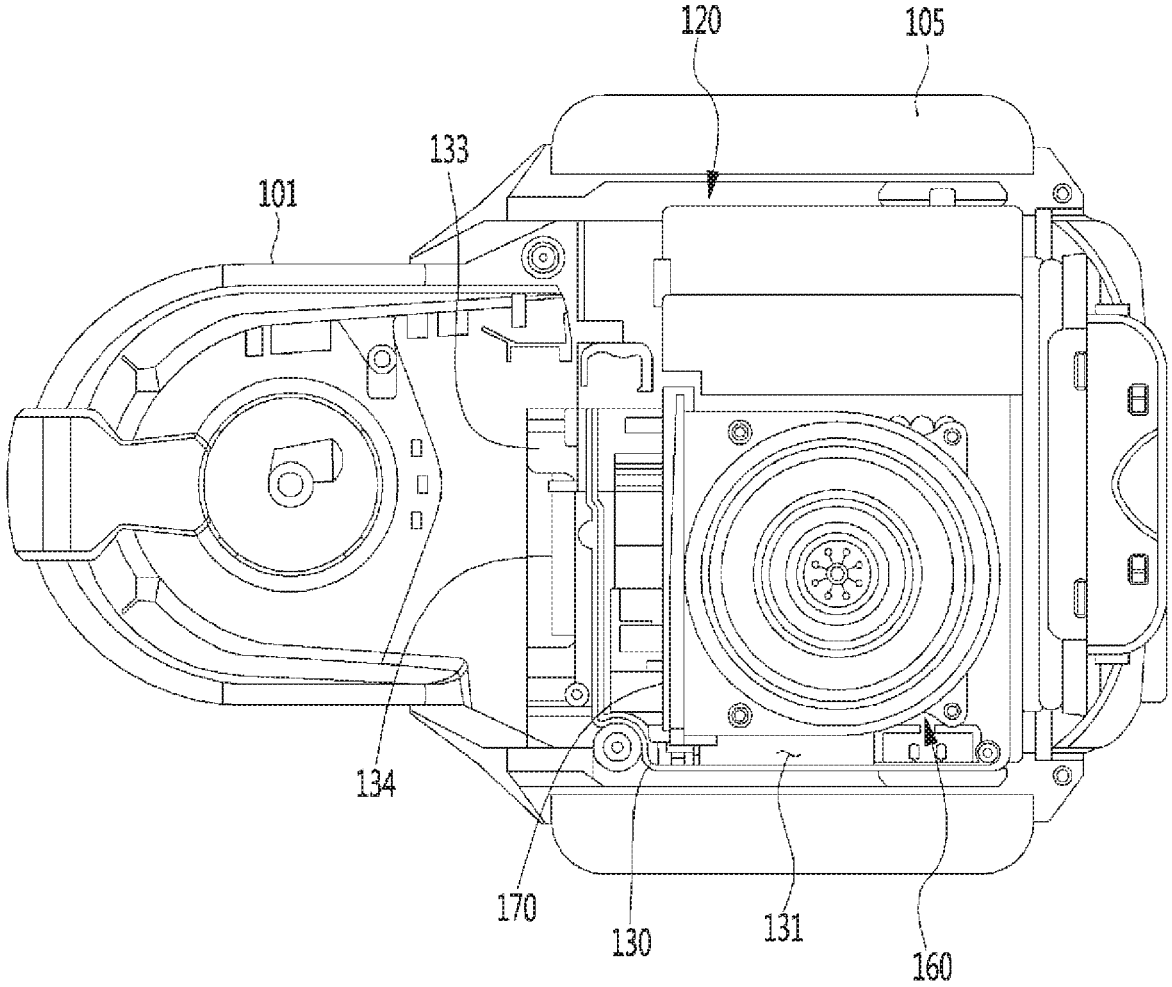
FIG. 3 is a top view illustrating a suction motor assembly installed in a main body according to an embodiment.
Figure 4:
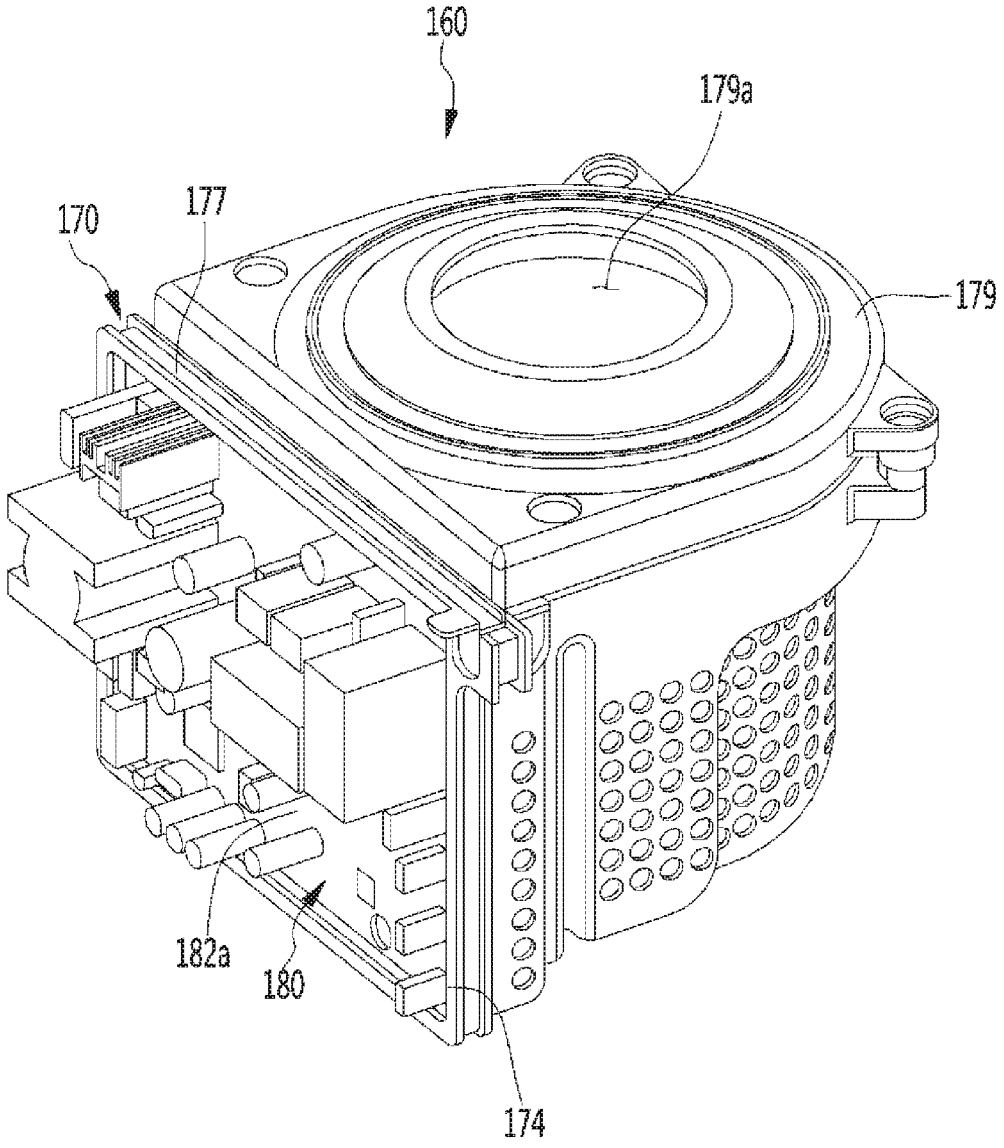
FIG. 4 is a perspective view of the suction motor assembly according to an embodiment.
Figure 5:
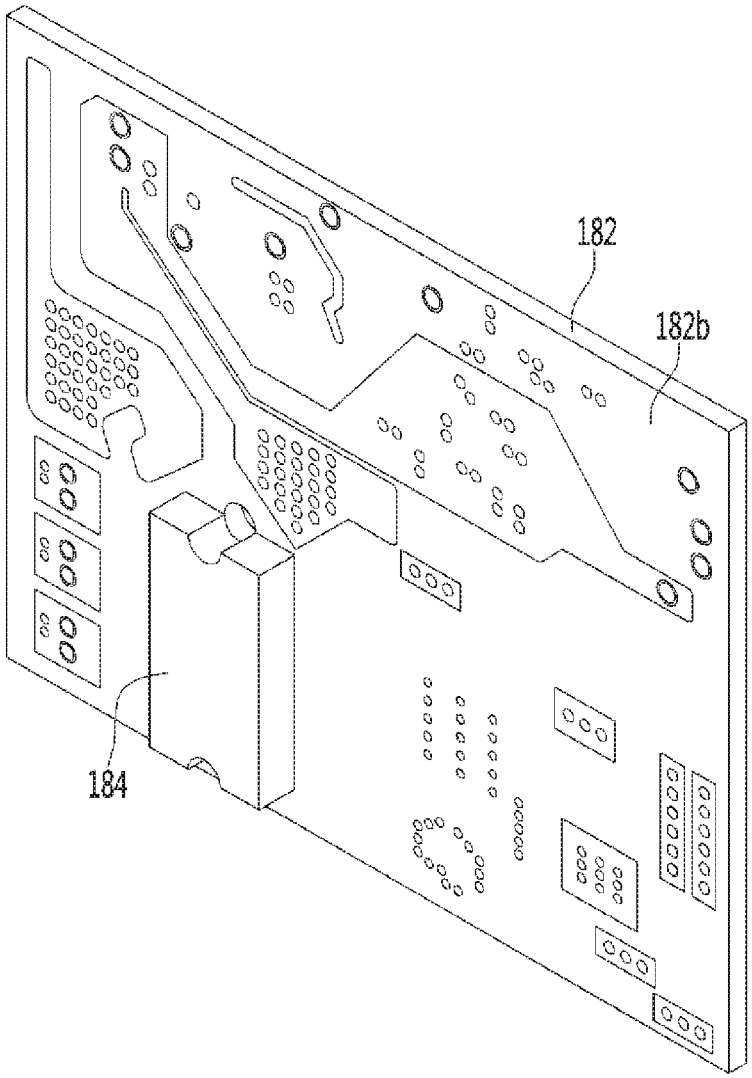
FIG. 5 is a view illustrating an inverter unit or module according to an embodiment.
Figure 6:
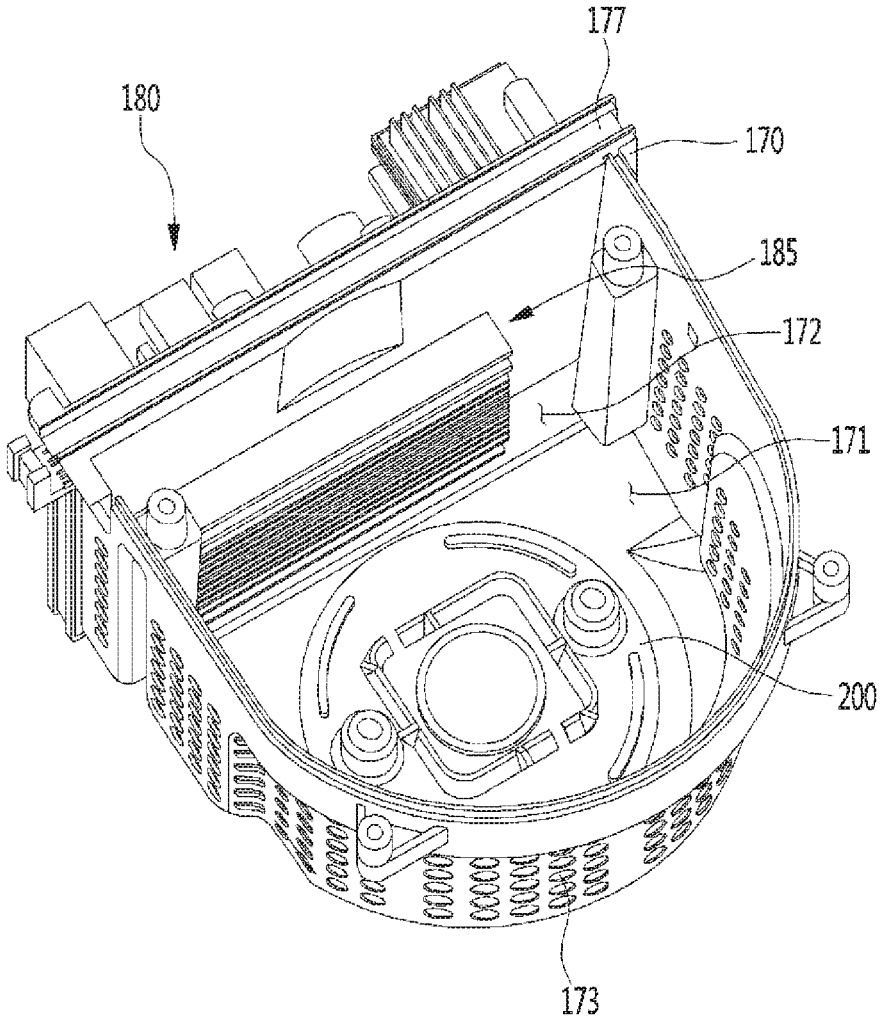
FIG. 6 is a view illustrating a suction motor separated from the suction motor assembly of FIG. 4.
Figure 7:
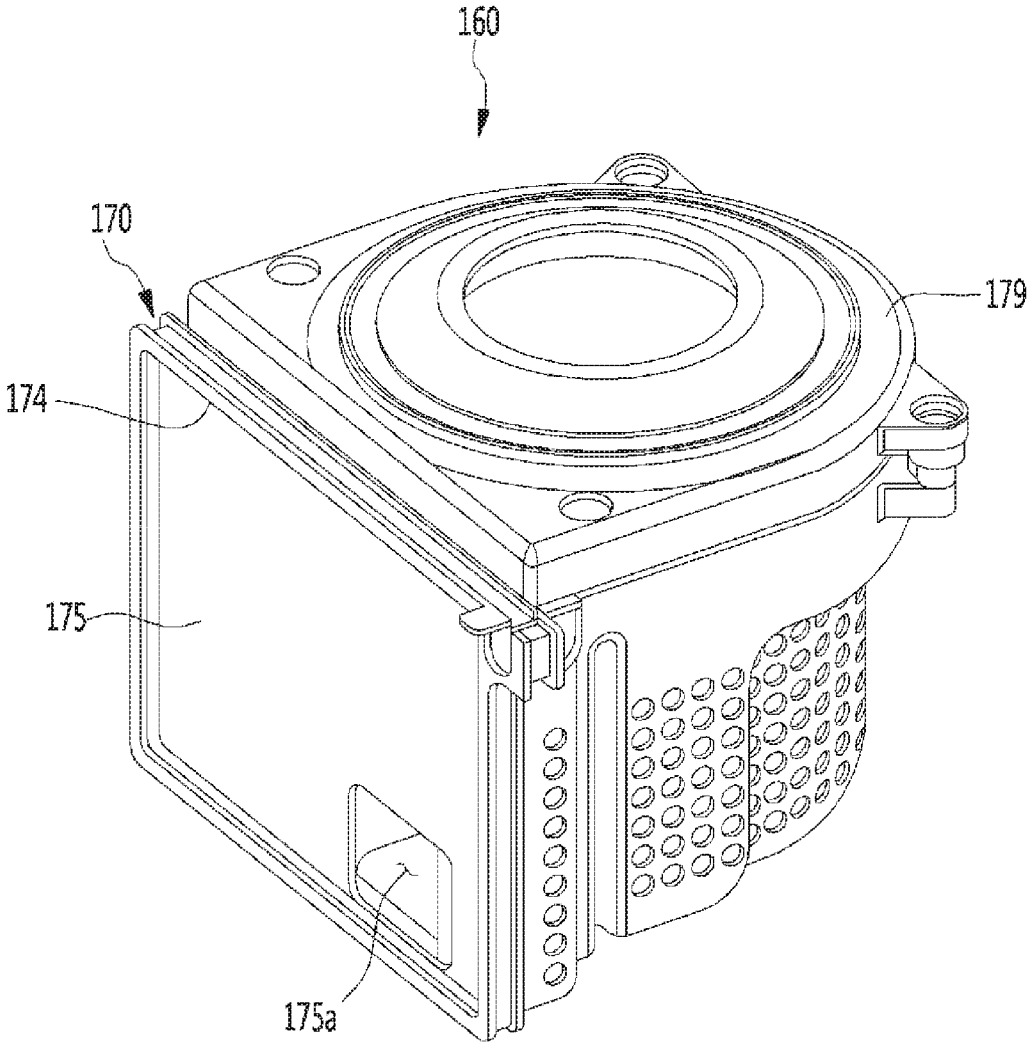
FIG. 7 is a view illustrating the inverter unit separated from the suction motor assembly of FIG. 4.

Referring to FIGS. 1 and 2, a vacuum cleaner 1 may include a cleaner body 10 having a suction motor 161 that generates a suction force, and a suction unit or module 20 that guides air and objects such as dust to the cleaner body

10. The suction unit 20 may include a suction part or head 21 that suctions the dust on a surface to be cleaned, for example, a floor surface, and connection parts or connectors 22, 23 and 24 that connect the suction part 21 to the cleaner body 10. The connection parts 22, 23 and 24 may include an extension tube 24, which may be connected to the suction part 21, a handle 22, which may be connected to the extension tube 24, and a suction hose 23, which may connect the handle 22 to the cleaner body 10.

The vacuum cleaner 1 may further include a separator, which may separate the air and the dust suctioned through the suction unit 20 from each other, and a container 110, which may store the dust separated by the separator. The container 110 may be separably installed or provided at the cleaner body 10. The separator may be manufactured separately from the container 110, or may form one module with the container 110. The separator may be, for example, a cyclone module.

The vacuum cleaner 1 may include a battery assembly or battery 120 that supplies power to operate the suction motor 161, a charger 140 that charges up the battery assembly 120, and a power cord 30, which may be separably connected to the cleaner body 10 and may supply commercial power to the cleaner body 10. The power cord 30 may include a plug 31, which may be connected to an electrical outlet, and a charger connector 32, which may be connected to the cleaner body 10. The cleaner body 10 may include a body connector 102, to which the charger connector 32 may be connected.

The battery assembly 120 may include a plurality of battery cells 121. The plurality of battery cells 121 may be connected in series. The charger 140 may perform rectification and smoothing, and thus, may convert an applied AC voltage into a DC voltage. The charger 140 may supply the converted DC voltage to the battery assembly 120. The charger 140 may include a transformer 141 that transforms an input AC voltage, and AC/DC converter 142 that converts the AC voltage output from the transformer 141 into the DC voltage.

The DC voltage output from the AC/DC converter 142 may also be transformed by the transformer 141, but the embodiment and configuration of the charger 140 are not limited thereto. The charger 140 without a transformer may include a circuit that prevents the AC/DC converter 142 from converting a DC voltage into an AC voltage. The AC/DC converter 142 may be an isolated converter. As the AC/DC converter may be a known configuration, detailed description thereof has been omitted. The suction motor 161 may be a brushless DC (BLDC) motor.

The vacuum cleaner 1 may further include a user interface 190. The user interface 190 may receive an operation command for the vacuum cleaner 1, and may also display operation information or state information of or about the vacuum cleaner 1. The user interface 190 may be provided at one or both of the handle 22 and the cleaner body 10. The user interface 190 may have a structure in which an input part or module and a display part or module may be integrally formed, but may also have a structure in which the input part and the display part may be separately formed.

A selection of inputs, for example, a power-on, a cleaning mode, a degree of an intensity of the suction force, in the vacuum cleaner 1 may be selected through the input part. The display part may display at least information of or about the battery assembly 120. When a residual battery value of the battery assembly 120 reaches a reference value, a controller 150 may enable the display part to display information notifying that charging of the battery assembly 120 is required.

The display part may indicate the residual battery value of the battery assembly 120 continuously or by stages. For example, the display part may indicate the residual battery value of the battery assembly 120 as a number or character or a graph. The display part may include a plurality of light emitting parts or devices, and may indicate the residual battery value of the battery assembly 120 by changing a number of light emitting parts which are turned on. The display part may indicate the residual battery value of the battery assembly 120 by changing a color of light emitted from the light emitting part.

When the battery assembly 120 is charging, the power cord 30 may be connected to the vacuum cleaner 1, and when a cleaning operation is performed using the vacuum cleaner 1, the power cord 30 may be separated from the vacuum cleaner 1, and thus, the vacuum cleaner 1 may be able to move more freely. As the vacuum cleaner 1 receives power from the battery assembly 120 without having a power cord reel, a distance within which the vacuum cleaner 1 may move about may not be limited. As the vacuum cleaner 1 may not move over a cord wound on the power cord reel and the cord may not need to be arranged while the vacuum cleaner 1 is moving, the vacuum cleaner 1 may move about smoothly.

Referring FIGS. 3 to 7, the vacuum cleaner 1 may further include a suction motor assembly 160. The suction motor assembly 160 may include the suction motor 161 and a motor housing 170 accommodating the suction motor 161. The cleaner body 10 may further include a base 101 that supports one or more wheels 105, and a motor frame 130, which may be provided at the base 101 and accommodate the suction motor assembly 160.

The motor frame 130 may be integrally formed at the base 101 or separably coupled to the base 101. The battery assembly 120 may be located between one side of the motor frame 130 and the wheel 105. The motor frame 130 may include an accommodating chamber 131 for the suction motor assembly 160. The motor frame 130 may further include a charger installation part 133, at which the charger 140 may be installed. The charger 140 may be inserted into the charger installation part 133 from an outside of the motor frame 130, such that the charger installation part 133 may be provided at an outside of the accommodating chamber 131.

One or more heat radiation holes 134 may be provided at the charger installation part 133 to discharge heat generated from the charger 140. The charger 140 may be installed at the charger installation part 133 in a horizontal direction, and the suction motor assembly 160 may be accommodated in the accommodating chamber 131 of the motor frame 130 in a vertical direction.

The motor housing 170 may include a motor chamber 171, which may accommodate the suction motor 161. The suction motor assembly 160 may further include a housing cover 179 to cover the suction motor 161, which may be accommodated in the motor chamber 171. The housing cover 179 may be coupled to an upper side of the motor housing 170 and may include an air inlet 179*a*, through which air may flow.

The motor housing 170 may further include an installation part or portion 174 to install an inverter unit or module 180. The inverter unit 180 may include a circuit board 182 that provides one or more heating components. The circuit board 182 may be installed at the installation part 174. For example, the circuit board 182 may be inserted into the installation part 174. The circuit board 182 may be provided at an outer side of the motor chamber 171. The one or more heating components may include an inverter 184. The inverter 184 may include a plurality of switching elements. The inverter 184 may supply a voltage from the battery assembly 120 to the suction motor 161 so that the suction motor 161 may use the voltage.

A plurality of heat generating components may be installed or provided on the circuit board 182. A portion of the plurality of heat generating components may be installed on a first surface 182*a* of the circuit board 182, and the inverter 184 may be installed on a second surface 182*b*, which may be opposite the first surface 181*a*. The motor housing 170 may further include a partition wall 175 to partition the installation part 174 and the motor chamber 171. An opening 175*a*, through which the inverter 184 may pass, may be formed at the partition wall 175.

The inverter unit 180 may be installed or provided at the installation part 174 when the inverter 184 installed on the second surface 182*b* of the circuit board 182 faces the partition wall 175. When the inverter unit 180 is installed at the installation part 174, at least a portion of the inverter 184 may pass through the opening 175*a*.

The suction motor assembly 160 may further include a heat radiating member or radiator 185 (e.g., heat sink) for the inverter 184. The heat radiating member 185 may include a plurality of heat radiating fins. The heat radiating member 185 may be accommodated in the motor chamber 171. The heat radiating member 185 may be in direct contact with the inverter 184, which may pass through the opening 175*a* of the partition wall 175. A portion of the heat radiating member 185 may pass through the opening 175*a* and may be in contact with the inverter 184.

In the motor chamber 171, air discharged from the suction motor 161 may flow, heat discharged from the inverter 184 may be delivered to the heat radiating member 185, and heat delivered to the heat radiating member 185 may be discharged from the heat radiating member 185 by the air from the motor chamber 171. As the heat radiating member 185 is located within the motor chamber 171, the heat radiating member 185 may be cooled by the air in the motor chamber 171, and accordingly, heat from the inverter 184 may be rapidly discharged.

A heat transfer material may be provided between the inverter 184 and the heat radiating member 185. For example, the heat transfer material may be coated on a surface of at least one of the inverter 184 and the heat radiating member 185. The inverter 184 and the heat radiating member 185 may indirectly contact each other via the heat transfer material.

The circuit board 182 and the inverter 184 and the heat radiating member 185 may be fastened together by a single fastening member. For example, the fastening member may pass through the circuit board 182 and the inverter 184, and then may be fastened with the heat radiating member 185. Therefore, as the circuit board 182, the inverter 184 and the heat radiating member 185 are fastened by a fastening member, contact between the inverter 184 and the heat radiating member 185 may be stably maintained.

The motor housing 170 may be provided with a seating groove 172 to seat the heat radiating member 185. As the heat radiating member 185 may be seated on the seating groove 172 of the motor housing 170, a horizontal movement of the heat radiating member 185 may be prevented when fastening the inverter 184 and the heat radiating member 185 using the fastening member, and thus, a fastening time using the fastening member may be reduced and fastening may be easily performed.

The motor housing 170 may further include a plurality of holes 173, through which air having passed the suction motor 161 may pass. The motor housing 170 may further include a motor supporter or motor support 200 to support the suction motor 161. The motor supporter 200 may absorb vibration of or from the suction motor 161 while supporting the motor housing 170. For example, the motor supporter 200 may be formed of a rubber material. The motor supporter 200 may be coupled to a bottom wall of the motor housing 170, and a portion of the motor supporter 200 may pass through the bottom wall of the motor housing 170. In addition, the motor housing 170 may be provided with an accommodating groove 177 that accommodates a sealing member or sealer 178 (shown in FIG. 8). For example, the accommodating groove 177 may be provided around the installation part 174.

Figure 8:
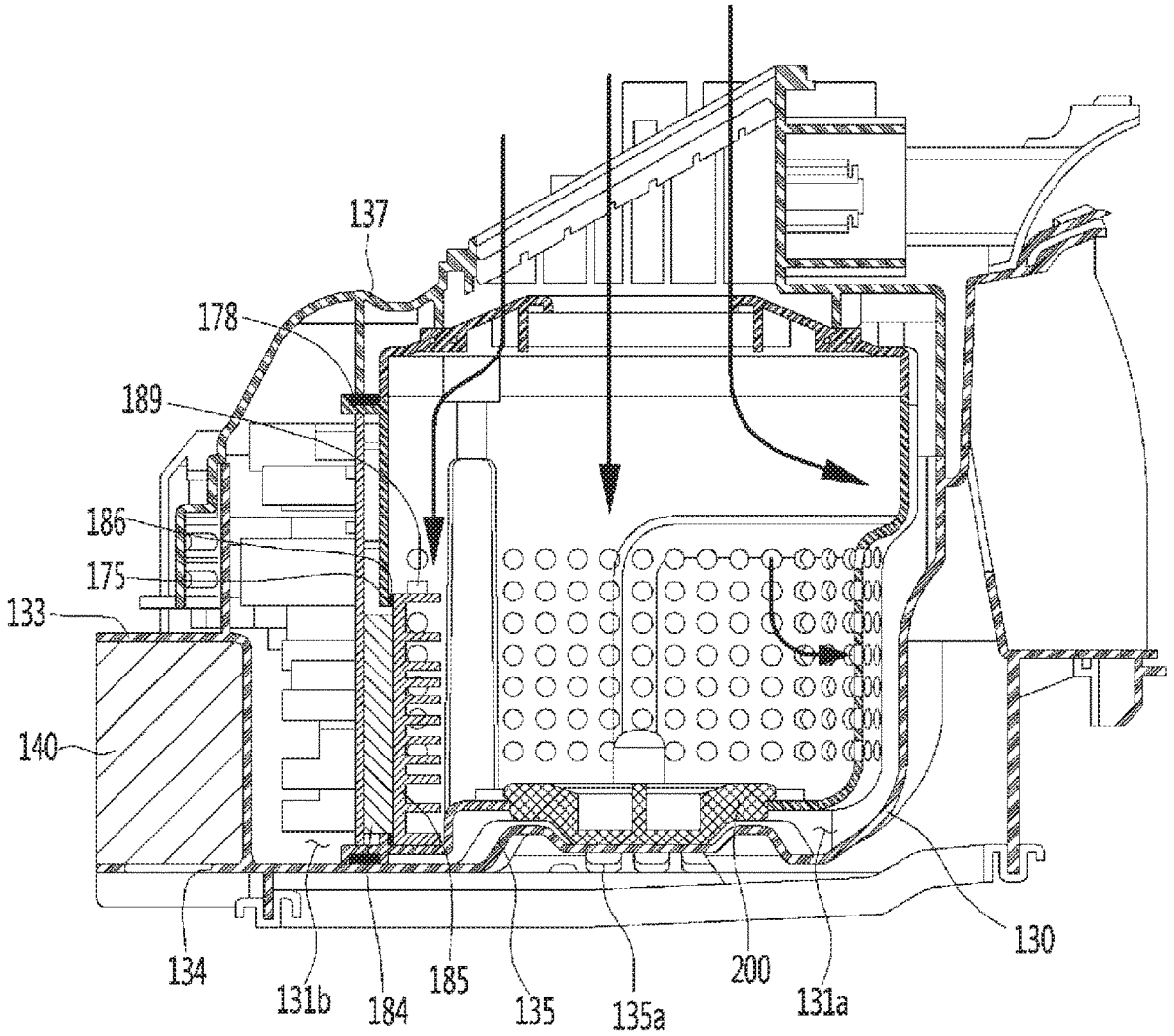
FIG. 8 is a cross-sectional view illustrating the suction motor assembly accommodated in a motor frame according to an embodiment.

FIG. 8 is a cross-sectional view illustrating the suction motor assembly accommodated in a motor frame according to an embodiment. Referring to FIG. 3 to FIG. 8, the suction motor assembly 160 may be accommodated in the accommodating chamber 131 of the motor frame 130. When the suction motor assembly 160 is accommodated in the accommodating chamber 131, the suction motor assembly 160 may partition the accommodating chamber 131 into a first chamber 131*a* and a second chamber 131*b*. The first chamber 131*a* may be a chamber in which the air, which has passed the suction motor 161, may flow and the second chamber 131*b* may be a chamber at which the inverter unit 180 may be located.

As the sealing member 178 is provided in the motor housing 170, foreign substances in the first chamber 131*a* may be prevented from moving into the second chamber 131*b* by the sealing member 178. An upper side of the motor frame 130 may be covered by a frame cover 137. The frame cover 137 may cover the accommodating chamber 131, and may be in contact with the sealing member 178 provided in the motor housing 170.

A sealing member or sealer 186 may be provided between the partition wall 175 and the heat radiating member 185. The sealing member 186 may prevent foreign substances in the first chamber 131*a* from moving into the second chamber 131*b* between the partition wall 175 and the heat radiating member 185.

The sealing member 186 may be installed or provided either at the heat radiating member 185 or at the partition wall 175. When the inverter 184 and the heat radiating member 185 are fastened, the sealing member 186 may surround a circumference of the inverter 184. Therefore, the air discharged from the dust separator may pass through the frame cover 137, pass the suction motor 161 and then be discharged into the motor chamber 171. The air discharged into the motor chamber 171 may be discharged to the outside of the vacuum cleaner 1 after being discharged to the first chamber 131*a*.

According to an embodiment, a motor housing may be located within a accommodating chamber formed by the motor frame, and since a suction motor is located within a motor chamber formed in the motor housing, noise caused by the suction motor 161 may be minimized. That is, the suction motor 161 may be surrounded by a wall forming a plurality of chambers, and thus, noise of or from the suction motor 161 may be reduced.

Since the charger 140 is installed at the charger installation part 133 outside of the motor frame 130, a space where the charger 140 is located and a space, or the second chamber, where the inverter unit 180 is located may be divided or separated from each other to prevent interaction of heat generated by the inverter unit 180 and the charger 140. The inverter unit 180 may be located between the charger 140 and the suction motor 161. For example, the circuit board 182, the inverter 184 and the heat radiating member 185 may be located between the charger 140 and the suction motor 161.

The vacuum cleaner 1 may further include a temperature sensor 189 to sense a temperature of the heat radiating member 185. When the temperature sensed by the temperature sensor 189 reaches a reference temperature, the controller 150 may stop operation of the suction motor 161.

The motor frame 130 may further include a support part or support 135 to support the motor supporter 200. The support part 135 may protrude upward from a bottom of the motor frame 130. A plurality of air holes, through which the air having passed the suction motor 161 may pass, may be formed in the motor frame 130, and as the support part 135 protrudes upward from the bottom of the motor frame 130, one or more air holes 135*a* may be formed in the support part 135. Thus, a total area of the plurality of air holes through which air may pass may increase, and a smooth flow of air may be possible.

In addition, since the support part 135 protrudes upward from the bottom of the motor frame 130, across-sectional area of a portion of an air flow path between the motor frame 130 and the base 101 may be increased, and thus a smooth flow of air may be possible. That is, the air having flowed into the air flow path may be discharged to the outside through a discharging part or portion of the cleaner body. As the cross-sectional area of the air flow path is increased, an air flow may become smooth.

Embodiments disclosed herein provide a vacuum cleaner which may be able to effectively cool heat generated from a circuit board, able to be easily moved, and able to minimize noise of or from a suction motor.

According to embodiments disclosed herein, a vacuum cleaner may include a cleaner body having a suction motor assembly to generate a suction force; and a suction part or head configured that communicates with the cleaner body, wherein the suction motor assembly includes a motor; a motor housing having a chamber to accommodate the motor; a housing cover configured to cover the motor housing and provided with an air inlet; a circuit board provided outside of the chamber and having at least one heating or heat generating component installed thereupon; and a heat radiating member or heat sink located at the chamber and in contact with the at least one heating component, and an installation part to install the circuit board may be provided at the motor housing.

According to embodiments disclosed herein, a vacuum cleaner may include a cleaner body having a motor frame; and a suction motor assembly accommodated in the motor frame and generating a suction force, the suction motor assembly comprising a motor; a motor housing having a chamber to accommodate the motor; a motor support connected to a lower side of the motor housing; a circuit board provided outside of the motor chamber and having at least one heating or heat generating component installed thereupon; and a heat radiating member or heat sink located at the chamber and in contact with the at least one heating component, and the motor frame includes an support part that protrudes upward from a bottom of the motor frame to support the motor support.

Terms such as first, second, A, B, (a), (b) or the like may be used herein when describing components of the present disclosure. Each of these terminologies is not used to define an essence, order or sequence of a corresponding component but used merely to distinguish the corresponding component from other component(s). If it is described in the specification that one component is "connected," "coupled" or "joined" to another component, the former may be directly "connected," "coupled" or "joined" to the latter or "connected," "coupled" or "joined" to the latter via another component.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:
a cleaner body;
a suction head that communicates with the cleaner body;
a motor frame; and
a suction motor assembly to generate a suction force, the suction motor assembly being positioned in the motor frame and including:
a motor;
a motor housing having a chamber to accommodate the motor;
a motor support connected to a lower side of the motor housing and formed of a rubber material, a section of the motor support passing through a bottom wall of the motor housing;
a housing cover configured to cover the motor housing and provided with an air inlet;
a circuit board provided at an outside of the chamber; and
a heat sink provided in the chamber,
wherein an installation wall to accommodate the circuit board is provided at a side of the motor housing,
wherein the motor housing includes the installation wall and a partition wall to partition the chamber, the partition wall having an opening,
wherein the circuit board is installed in an erect state,
wherein the circuit board includes a first surface on which a first portion of a plurality of heat generating components is installed, and a second surface opposite the first surface and that faces the partition wall,
wherein a second portion of the plurality of heat generating components is installed on the second surface of the circuit board, and the second portion of the plurality of heat generating components passes through the opening of the partition wall in a horizontal direction to be in contact with the heat sink,
wherein the heat sink is located between the second portion and the plurality of heat generating components and the motor,
wherein the air inlet passes through the housing cover in a vertical direction,
wherein a sealer is provided between the partition wall and the heat sink,
wherein the motor frame includes a support that protrudes upward from a bottom of the motor frame to support the motor support,
wherein the support includes a recess that is recessed downward to receive a portion of the motor support,
wherein a portion of the heat sink is positioned between the motor support and the circuit board, and
wherein the partition wall extends to a bottom of the motor housing.

2. The vacuum cleaner according to claim 1, wherein the second portion of the plurality of heat generating components includes an inverter.

3. The vacuum cleaner according to claim 1, wherein the motor housing includes a seating groove recessed downward to seat the heat sink.

4. The vacuum cleaner according to claim 1, further comprising a fastener to fasten the circuit board, at least one of the plurality of heat generating components, and the heat sink.

5. The vacuum cleaner of claim 1, wherein the air inlet is positioned higher than the heat sink.

6. A vacuum cleaner comprising:
a cleaner body having a motor frame; and
a suction motor assembly accommodated in the motor frame and generating a suction force, the suction motor assembly including:
a motor;
a motor housing having a chamber to accommodate the motor, and formed as a separate component to the motor frame;
a motor support connected to a lower side of the motor housing and formed of a rubber material, a part of the motor support passing through a bottom wall of the motor housing;
a circuit board provided at an outside of the chamber and having at least one heat generating component installed thereupon; and
a heat sink located in the chamber and in contact with the at least one heat generating component
wherein at least a portion of the bottom wall of the motor housing is spaced apart from the motor frame in a vertical direction,
wherein the motor frame includes a support that protrudes upward from a bottom of the motor frame to support the motor support,
wherein the support includes a recess that is recessed downward to receive a portion of the motor support,
wherein a portion of the heat sink is positioned between the motor support and the circuit board,
wherein the support includes at least one air hole, through which air having passed the motor passes.

7. The vacuum cleaner of claim 6, wherein the motor housing includes a seating groove to seat the heat sink, and a plurality of holes that are positioned to be vertically aligned with the seating groove to be provided adjacent to the heat sink.

8. The vacuum cleaner according to claim 6, further comprising a battery assembly to provide power to the motor and a charger to charge the battery assembly, wherein the at least one heat generating component supplies a voltage from the battery assembly to the motor.

9. The vacuum cleaner according to claim 8, wherein the charger is installed at an outside of the motor frame.

10. The vacuum cleaner according to claim 9, wherein the motor housing includes a partition wall having an installation part on which the circuit board is installed and an opening through which the at least one heat generating component and the heat sink pass.

11. The vacuum cleaner of claim 8, further comprising a pair of wheels that support the cleaner body, wherein the suction motor assembly is positioned between the pair of wheels, and the battery assembly is positioned between the suction motor assembly and one of the pair of wheels.

12. The vacuum cleaner of claim 8, wherein the circuit board is positioned between the charger and the motor.

* * * * *